US007345414B1

(12) United States Patent
Miller et al.

(10) Patent No.: US 7,345,414 B1
(45) Date of Patent: Mar. 18, 2008

(54) LAMP FOR NIGHT VISION SYSTEM

(75) Inventors: Nathaniel Miller, Berkeley, CA (US); Rajasingh S. Israel, Westlake, OH (US); Tianji Zhao, Mayfield Heights, OH (US); Peter W. Brown, Twinsburg, OH (US); Bart P. Terburg, Mayfield Village, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/543,971

(22) Filed: Oct. 4, 2006

(51) Int. Cl.
*H01J 63/04* (2006.01)
*H01J 1/00* (2006.01)

(52) U.S. Cl. ..... 313/489; 313/110; 250/495.1; 250/504 R

(58) Field of Classification Search ..... 313/110, 313/489, 112, 635, 493; 250/493.1, 494.1, 250/495.1, 504 R, 504 H, 503.1
See application file for complete search history.

(56) References Cited

U.S. PATENT DOCUMENTS

| | | | | |
|---|---|---|---|---|
| 4,435,445 | A | 3/1984 | Allred et al. | |
| 4,467,238 | A | 8/1984 | Silverstein et al. | |
| 4,508,054 | A | 4/1985 | Baumberger et al. | |
| 4,701,663 | A | 10/1987 | Kawakatsu et al. | |
| 4,987,343 | A | 1/1991 | Kosmatka et al. | |
| 5,360,659 | A * | 11/1994 | Arends et al. | 428/216 |
| 5,540,978 | A * | 7/1996 | Schrenk | 428/212 |
| 6,382,816 | B1 | 5/2002 | Zhao et al. | |
| 7,098,775 | B2 | 8/2006 | Perlo et al. | |
| 2004/0021420 | A1 * | 2/2004 | Tsuda et al. | 313/638 |
| 2004/0240221 | A1 | 12/2004 | Choi | |
| 2005/0236960 | A1 | 10/2005 | Kupper et al. | |
| 2006/0050513 | A1 | 3/2006 | Brauneck et al. | |
| 2006/0050523 | A1 | 3/2006 | Schmidt | |

FOREIGN PATENT DOCUMENTS

| | | |
|---|---|---|
| DE | 3932216 A1 | 4/1991 |
| EP | 1072841 A2 | 1/2001 |

OTHER PUBLICATIONS

L.Küpper, C.Knight, Coating Technology of Automotive Bulbs, *SAE Technical Publication SP-1875*, #2004-01-0799, Society of Automotive Engineers, Warrandale, PA (2004).
S.Yagi, S.Kobayashi, T.Inoue, T.Hori, N.Michiba, K.Okui, The Development of Infrared Projector, *SAE Technical Publication SP-1787*, #2003-01-0987, Society of Automotive Engineers, Warrandale, PA (2003).

(Continued)

*Primary Examiner*—Sandra O'Shea
*Assistant Examiner*—Bao Q. Truong
(74) *Attorney, Agent, or Firm*—Fay Sharpe LLP

(57) ABSTRACT

An electric lamp assembly 10 for emitting near infrared radiation includes a reflector housing 20 and a lamp vessel 24 positioned within the reflector housing. A source of illumination 28 is enclosed within the lamp vessel. A continuous multi-layer interference film 40 on an exterior surface 42 of the lamp vessel transmits near infrared radiation within the range of 850-1100 nm and is substantially non-transmissive towards visible radiation.

19 Claims, 7 Drawing Sheets

OTHER PUBLICATIONS

B.Fleury, A High Performance Night Vision System, *Proceedings of the 5th International Symposium on Progress in Automobile Lighting* (*PAL*), pp. 281-290, Herbert Utz Verlag, Darmstadt, Germany (2003).

I.Inoue, S.Yagi, The Development of an Infrared Projector, *Proceedings of the 5th International Symposium on Progress in Automobile Lighting* (*PAL*), pp. 441-450, Herbert Utz Verlag, Darmstadt, Germany (2003).

W.Kesseler, M.Kleinkes, J.Locher, G.Bierleutgeb, Infrared Based Driver Assistance for Enhanced Perception at Night, *Proceedings of the 5th International Symposium on Progress in Automobile Lighting* (*PAL*), pp. 497-506, Herbert Utz Verlag, Darmstadt, Germany (2003).

L.Küpper, J.Schug, Active Night Vision Systems, *SAE Technical Publication SP-1668*, #2002-01-0013, Society of Automotive Engineers, Warrandale, PA (2002).

M.Burg, B.Abel, K.Eichhorn, Infrared Headlamps for Active Night-Vision Systems, *Proceedings of the 4th International Symposium on Progress in Automobile Lighting* (*PAL*), pp. 91-98, Herbert Utz Verlag, Darmstadt, Germany (2001).

N.Martinelli, S.A.Boulanger, Cadillac DeVille Thermal Imaging Night Vision System, *SAE Technical Paper Series*, #2000-01-0323, Society of Automotive Engineers, Warrandale, PA (2000).

K.Rumar, *Night Vision Enhancement Systems: What Should They Do and What More Do We Need to Know?, The University of Michigan Transport Research Institute* (*UMTRI*), Report#UMTRI-2002-12, Ann Arbor, MI (2002).

J.M.Sullivan, J.Bärgman, G.Adachi, B.Schoettle, *Driver Performance and Workload Using a Night Vision System, The University of Michigan Transport Research Institute* (*UMTRI*), Report#UMTRI-2004-8, Ann Arbor, MI (2004).

K.Rumar, Night Vision Enhancement Systems (NVES)—Research and Requirements, *Proceedings of the 5th International Symposium on Progress in Automobile Lighting* (*PAL*), pp. 895-908, Herbert Utz, Verlag, Darmstadt, Germany (2003).

O.Tsimhoni, J.Bärgman, T.Minoda, M.Flannagan, *Pedestrian Detection with Near and Far Infrared Night Vision Enhancement, The University of Michigan Transport Research Institute* (*UMTRI*), Report#UMTRI-2004-38, Ann Arbor, MI (2004).

S.Geisler, R.Kiefer, A Study of Customer Education Materials for the Cadillac Night Vision System, *SAE Technical Publication SP-1875*, #2004-01-1091, Society of Automotive Engineers, Warrandale, PA (2004).

K.Rumar, Infrared Night Vision Systems and Driver Needs, *SAE Technical Publication SP-1787*, #2003-01-0293, Society of Automotive Engineers, Warrandale, PA (2003).

* cited by examiner

LAMP FOR NIGHT VISION SYSTEM

BACKGROUND OF THE INVENTION

The exemplary embodiment relates to the illumination arts. It finds particular application in connection with a lamp for use in a night vision system and will be described with reference thereto.

Vehicle headlights and fog lights provide visible illumination which assists the driver in seeing the road ahead. However, because the beams are angled downwards to prevent interference with the vision of oncoming drivers, they tend not to provide optimal illumination of potential road hazards. The driver has a relatively short time to react to the presence of hazards, such as stalled vehicles, road construction, wild animals, road debris, and the like. Various night vision systems have been developed to assist drivers. During night and adverse weather, night vision systems provide drivers with supplemental visual information, beyond the range of their headlamps. The large range provides the driver with more time to react in situations that pose unexpected danger. Such systems employ a camera which detects infrared radiation. The imaged radiation is visualized as a representational image which is presented to the driver via a video monitor mounted in the passenger compartment or through a head-up display, which projects the image congruently with the outside world into the driver's eye. These systems allow maximum illumination of the viewing region and therefore provide the driver with a good view when it is dark but without blinding other road users.

Two types of systems have been developed. Passive infrared systems detect objects based on their emitted thermal radiation in the far infrared (FIR). Only relatively warm objects, such as people and animals are detected, they do not readily detect objects which emit radiation at or close to background levels, such as stalled vehicles and road debris. Additionally, the detection systems employed to collect and analyze the infrared radiation are relatively complex and not generally amenable to passenger vehicles. Active, near infrared (NIR) systems use an IR-source to project infrared radiation onto a scene and image the radiation that is reflected by objects in the scene. This provides a relatively complete picture of the scene in front of the driver. Effective infrared sources are halogen lamps which emit a sizable portion of their radiation in the near infrared. However, they also emit in the visible range, which in automotive applications could blind an oncoming driver. A filter which filters out the visible light may be positioned in front of the lamp. Such filters, however, can become warped or damaged in use, allowing visible light to penetrate.

EP1072841A2, for example, discloses an infrared headlight in which an incandescent lamp is used as the infrared radiation source, whose incandescent filament emits both infrared radiation and light in the visible range during operation. A parabolic reflector deflects the infrared radiation to the desired direction and transmits the visible radiation. The reflector opening is covered by a filter disk, which is opaque to light in the visible range. Planar filters such as these are not generally suitable for automotive applications because the filtered radiation tends to produce a large amount of heat which can damage the filter.

DE3932216A1 discloses an illumination device for automotive applications, which can be used both as an infrared headlight and as a main beam. The illumination device has a reflector in which a light source is positioned. Infrared radiation can pass through a filter which reflects radiation in the visible range towards the light source. In the main beam mode, the filter is moved with respect to the light source such that it is ineffective, so that all of the radiation is reflected via the reflector towards the reflector opening. When dipped lights are selected, the filter is moved over the light source such that the illumination device emits only infrared radiation. This limits the device to the shorter distances which can be reached with the dipped beam.

BRIEF DESCRIPTION OF THE INVENTION

In accordance with one aspect of the invention, an electric lamp assembly for emitting near infrared radiation includes a reflector housing and a lamp vessel positioned within the reflector housing. A source of illumination is enclosed within the lamp vessel. A continuous multi-layer interference film on an exterior surface of the lamp vessel transmits near infrared radiation within the range of 850-1100 run and is substantially non-transmissive towards visible radiation.

In accordance with another aspect, an infrared night vision system includes a reflector housing and a lamp vessel positioned within the reflector housing. A source of illumination is enclosed within the lamp vessel. A continuous multi-layer interference film on an exterior surface of the lamp vessel transmits near infrared radiation within the range of 850-1100 nm and is substantially non-transmissive towards visible radiation. A camera receives infrared radiation reflected from an object which is emitted by the electric lamp assembly. A display which displays an image based on the reflected light received by the camera.

In another aspect, a method of operating an infrared night vision system includes supplying power to a source of illumination which emits radiation in both the visible and infrared regions of the electromagnetic spectrum, whereby radiation emitted by the source is transmitted by a lamp vessel and filtered by a continuous multi-layer interference film on an exterior surface of the lamp vessel which is substantially non-transmissive towards the visible radiation and is substantially transmissive to radiation in the range of 850-1100 nm. Infrared radiation reflected from an object which is emitted by the lamp vessel is received and an image based on the reflected radiation is displayed.

DETAILED DESCRIPTION OF THE INVENTION

In various aspects of the invention, a night vision system includes a lamp with a filter which is transmissive to infra-red (IR) radiation and substantially blocks all visible radiation. The filter may be in the form of a multi-layer coating comprising alternating layers of high and low refractive index materials and may further include a protective outer layer which resists degradation of the film at high temperatures. The lamp is suited to operation in automotive applications where the lamp may operate at relatively high temperatures without appreciable degradation of the filter.

For automotive active night-vision systems it is desirable to project near infrared radiation in the wavelength range of 850 nm to 1100 nm. It is also desirable that substantially no visible light be projected from the lamp as the lamp is generally angled in a high-beam position projecting much further than normal low beam headlights. It is also desirable that substantially no red light be projected from the lamp as automotive regulations do not permit red light on the front of the vehicle. To provide a high efficacy of the lamp in a detectable region of the spectrum, it is beneficial for infrared radiation with wavelength between 1100 nm and 2000 nm (the upper end of the near infrared region and far infrared region) to be reflected back to the filament.

Figure 1:
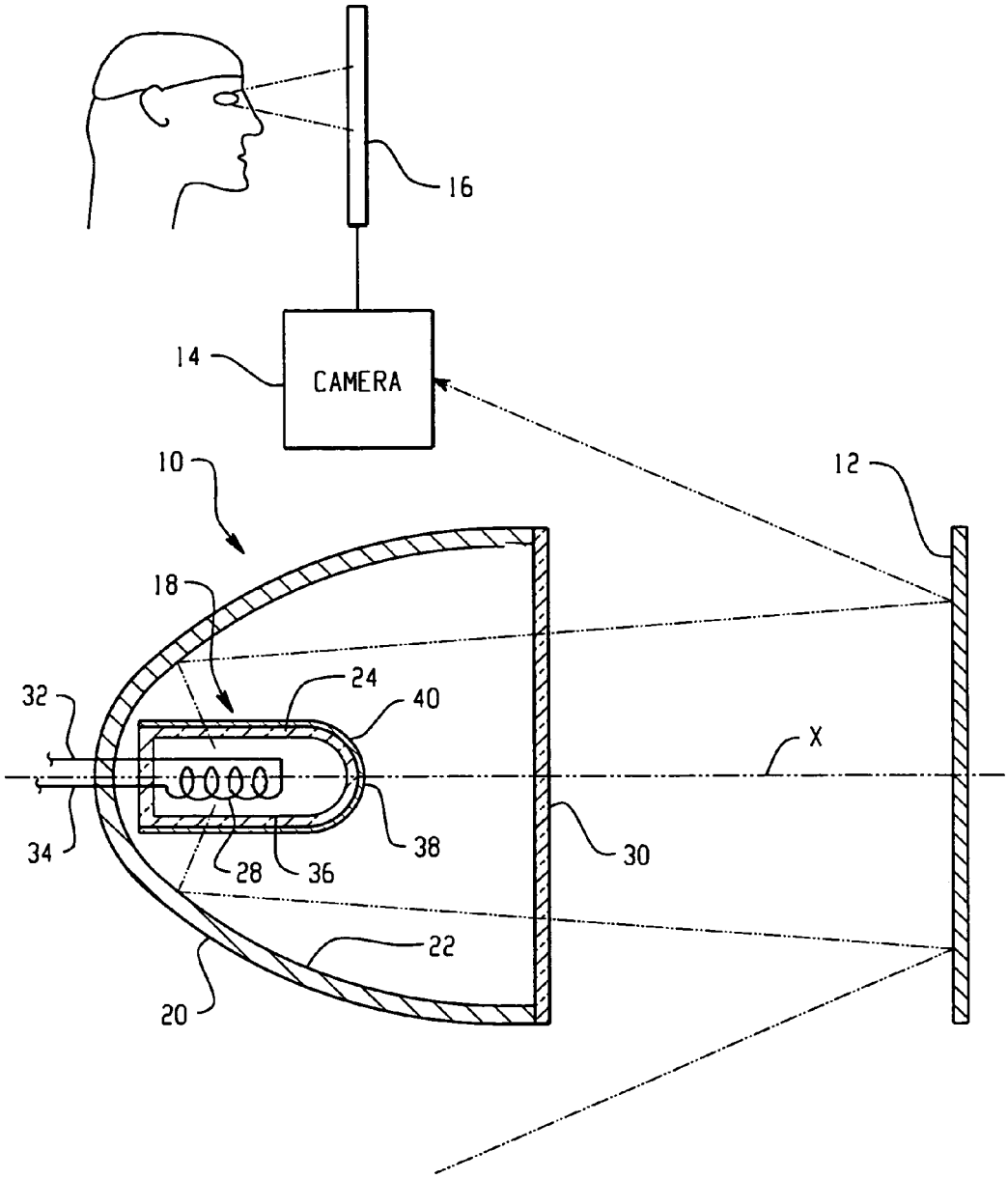
FIG. 1 illustrates a night vision system in accordance with one embodiment of the invention.

With reference to FIG. 1, a night vision system includes a lamp assembly 10 in the form of a vehicle headlamp, which emits IR radiation. During normal operation, the lamp assembly emits radiation in the near IR, which may be considered to extend from about 780-1400 nm. The lamp assembly emits substantially no light in the visible range (380-780 nm). Specifically, in the range of 380-750 nm (or more particularly, 380-780 nm), an average of less than 2% of the radiation emitted by a radiation (e.g., light) source within the lamp assembly is output from the lamp assembly, and in general, less than 1%. IR radiation emitted from the lamp assembly is reflected from a distant object 12, such as a person, animal, or vehicle on the road ahead, and is detected by a camera 14 positioned near the lamp assembly. The imaged radiation is visualized as a representational image which is presented to the driver via a display such as a video monitor 16 mounted in the passenger compartment or through a head-up display, which projects the image congruently with the outside world into the driver's eye. The camera can include a charge coupled device (CCD) or complementary metal-oxide semiconductor (CMOS) device employing silicon image sensors.

The lamp assembly 10 includes an electric lamp 18, which is mounted in a reflector housing 20 having a reflective interior surface 22. The lamp 18 includes a vessel or envelope 24. The vessel 24 may be formed from glass, quartz (high silica glass), or other IR transmissive material which is stable at lamp operating temperatures. The vessel 24 is generally cylindrical and has its longitudinal axis aligned with an axis X of the reflector housing 20. The vessel 24 is closed in vacuum tight manner to define an interior space 26 containing a halogen fill, typically comprising an alkyl bromide, such as $CH_2Br_2$, and an inert gas, such as argon or xenon. An incandescent radiation source 28, such as a filament in the form of a helical coil, which may be formed from tungsten, is disposed within the vessel 24. The fill is thus in contact with both the vessel 24 and the filament 28. The illustrated filament 28 has its longest dimension parallel to and substantially aligned with the longitudinal axis X, although other orientations are contemplated. When energized, the filament emits radiation in at least the IR and visible portions of the electromagnetic spectrum. Radiation from the filament 28 which passes through the vessel 24 may be reflected by the reflective interior surface 22 and may exit the lamp assembly through a transparent window or lens 30, which closes an otherwise open end of the reflector housing 20. While an incandescent radiation source 28 is illustrated, other infra red radiation sources are contemplated, such as electrodes which generate an arc discharge in a gap between the electrodes when the electrodes are energized.

The reflector housing 20 may be formed, for example, from plastic, glass, or aluminum. The housing may be itself reflective or may have a reflective coating formed thereon which defines the reflective surface 22. In the case of a plastic housing, the coating may be provided on an interior surface of the housing. In the case of glass, the coating may be provided on an interior or exterior surface. The reflective surface may be a metal, such as silver or aluminum, or may be defined by a dichroic coating comprising multiple layers of alternating higher and lower refractive index materials. The reflective surface may be generally parabolic, elliptical, or other suitable shape.

The illustrated lamp 18 is of the single ended type in which electrodes 32, 34 connecting the filament with a source of power extend from the lamp in the same direction, although double ended lamps are also contemplated. Vehicle headlamps that contain halogen or discharge light sources for general illumination are suitable lamps since they are also near-infrared light sources that can be optimized for near-infrared illumination. In general, halogen light sources are the most suitable for optimization since about 25% of the total radiated power of a high beam (60 W) light source lies in the near-infrared wavelength range from 800 to 1100 nm. In one embodiment, the lamp comprises an H7 halogen lamp having a cylindrical wall 36 and a rounded tip 38.

Figure 2:
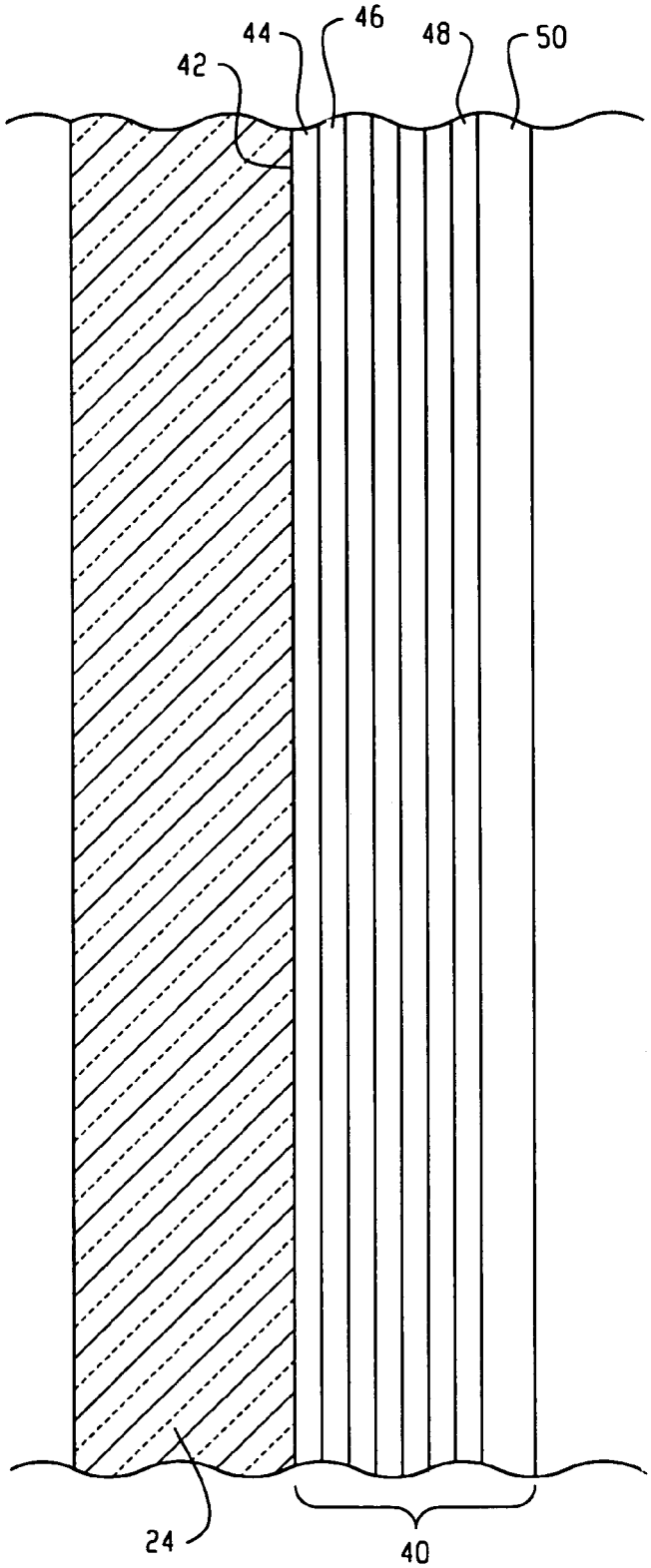
FIG. 2 illustrates a portion of the discharge vessel of FIG. 1 with a multilayer coating formed in accordance with one embodiment of the invention.

As shown in FIG. 2, which illustrates an enlarged view of a portion of the lamp vessel 24, the filter includes an optical interference film 40 which is formed on an exterior surface 42 of the vessel and in direct contact therewith. In general, the entire exterior surface 42 of the vessel is surrounded by the film 40 so that substantially all radiation emitted by the filament 28 which ultimately exits the lamp assembly 10 first passes through the film.

The optical interference film may be formed of multiple layers of refractory materials of high and low refractive index. Exemplary materials for forming the film 40 include one or more of silicon and germanium as low index of refraction materials, and one or more of silica ($SiO_2$), alumina ($Al_2O_3$), tantala (tantalum pentoxide, $Ta_2O_5$), titania (titanium dioxide, $TiO_2$), niobia (niobium pentoxide, $Nb_2O_5$), zirconia (zirconium oxide, $ZrO_2$), and vanadium oxide (e.g., $V_2O_3$, $V_2O_4$ or $V_2O_5$) as high index of refraction materials, or other combinations of these materials which provide boundaries between higher and lower refractive index materials. For example, the film may comprise alternating layers of silicon and silica, silicon and alumina, or a combination thereof. Such interference films may be applied using evaporation or sputtering techniques and also by chemical vapor deposition (CVD) and low pressure chemical vapor deposition (LPCVD) processes, as described, for example, in U.S. Pat. Nos. 4,949,005, 5,143,445, 5,569,970, 6,441,541, and 6,710,520.

An exemplary thin film optical interference filter 40 is provided on the outer surface 42 of the lamp vessel as a continuous coating consisting of alternating layers 44, 46, 48, 50, etc. of silicon and silica (or other high and low refractive index materials) arranged so as to adjust the pass-band and the stop-band characteristics of the emitted radiation of the lamp. The total number of layers 44, 46, etc. of silicon and silica can be as large as possible to obtain maximum optical performance. In some cases, stress cracking may be a concern if the overall thickness of the film 40 is too great. For example, the total number of layers may be from about five to about 100 and in one embodiment at least seven and in another embodiment, at least twelve layers. In another embodiment, the film includes less than forty layers. The layers 44, 46 may each have a thickness in the range of 10 to about 10,000 nm.

The exemplary interference film 40 is selected to reflect the visible radiation emitted by tungsten filament 28 as well as radiation in the far infrared (FIR, generally wavelengths above 1400 nm and up to about 2000 nm) back to the filament, while transmitting the near infrared (NIR) radiation. As mentioned in U.S. Pat. No. 5,569,970, there are a large number of computer programs commercially available for optimizing multilayer coatings for selection of specific pass bands and stop bands. Suitable thin film software programs of this type include OptiLayer (for design and evaluation), OptiChar (for optical characterization), and OptiRE (for post-production characterization) systems available from OptiLayer Ltd.

It has been found that an optimal pass band for a filter 40 for an automotive night vision system is from about 850 nm to about 1100 nm with a sharp cut on at 850 nm and a sharp cut off at about 1100 nm. In the optimal case, the transmission in the range of 380-780 nm is 0% and the transmission in the range 1100-2000 nm is also 0%, with transmission in the range 850-1100 nm being 100%. The exemplary interference film 40 may approximate this optimal pass band. In general, closer approximations can be achieved at higher numbers of optical interference layers. Useful films 40 are those which transmit substantially no radiation in the visible range. Specifically, the film 40 transmits an average of less than about 2% of the visible radiation emitted by the filament 28 in the range of 400-750 nm (or, more particularly, in the range of 380-780 nm). In one embodiment, the transmission in this wavelength range is about 1% or less and, in another embodiment, about 0.5%, or less. Such a film 40 may also transmit an average of less than about 30% of the radiation emitted by the filament in the range of 1200-1500 nm (or, more particularly, in the range of 1100-2000 nm), and in some embodiments, less than about 20%. The average transmittance in the range of 850-1100 nm may be at least about 60% and in some embodiments, at least 70% or at least 80%.

Figure 3:
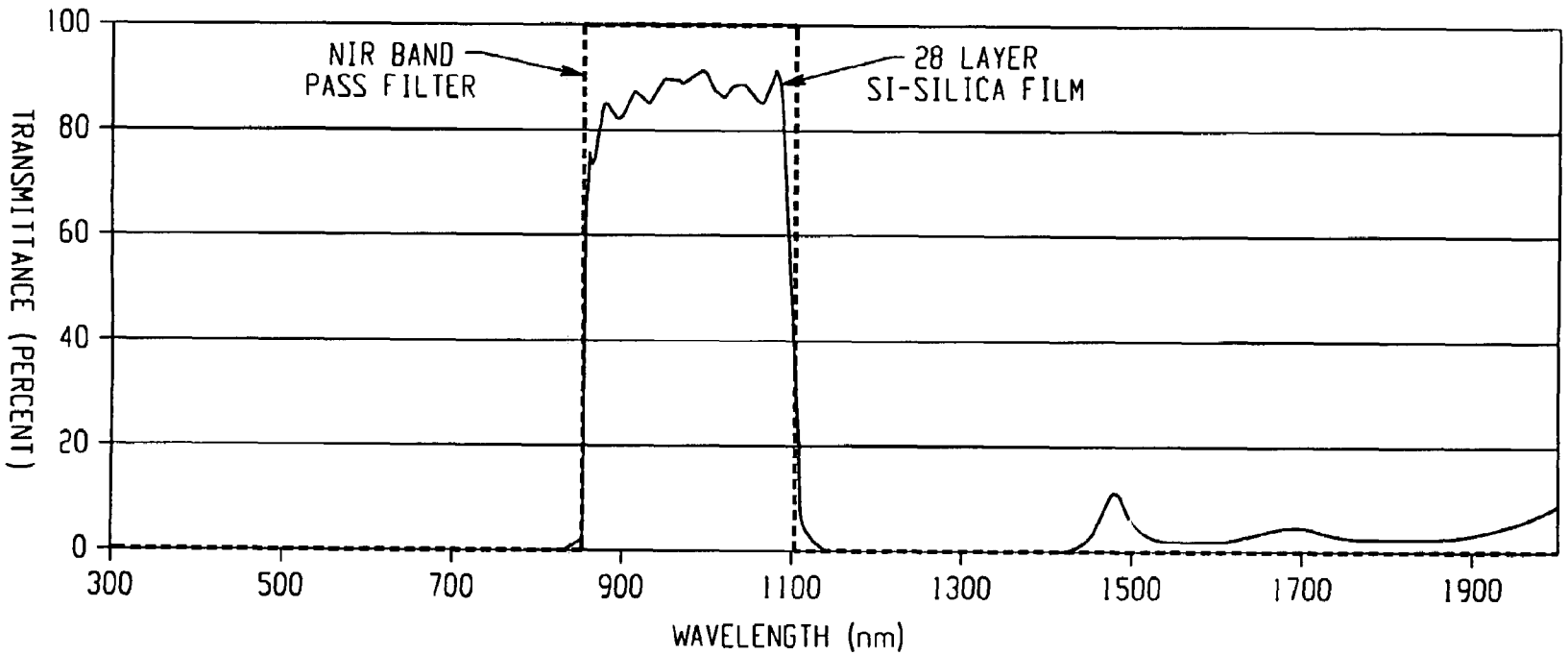
FIG. 3 illustrates a calculated transmittance curve for a twenty-eight layer Si-Silica film compared to an ideal pass filter in a wavelength range of 300-2000 nm.

For example, FIG. 3 shows the spectrum of an optimal NIR pass filter hand for automotive applications (dashed line) and the calculated spectrum of a 28 layer Si-Silica interference stack design (continuous line). The 28 layer design film (using ideal materials) has a calculated average transmittance in the visible range between 380 and 780 nm of 0.023%, a calculated average transmittance in the NIR range between 850 and 1100 nm of 84.59%, and a calculated average transmittance in the range between 1100 and 2000 nm of 3.42%.

Figure 4:
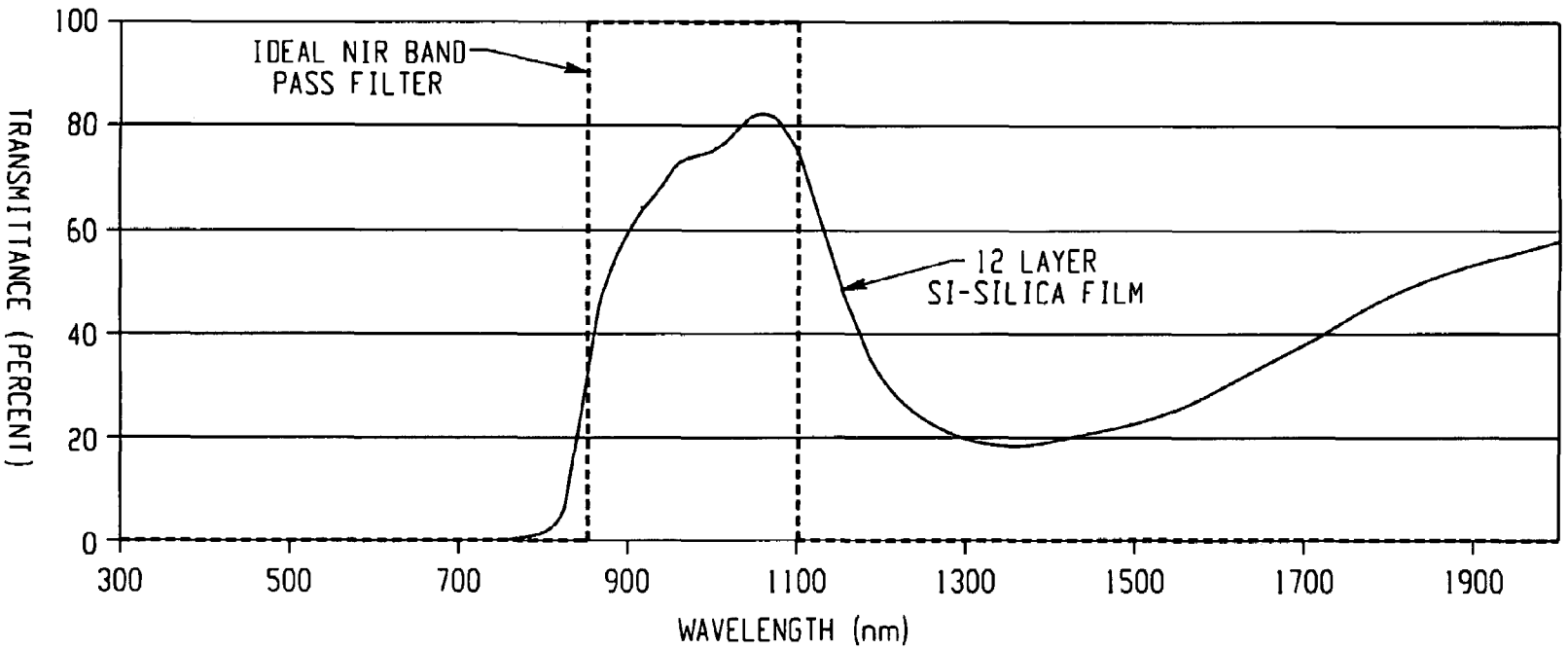
FIG. 4 illustrates a calculated transmittance curve for a twelve layer Si-Silica film compared to the ideal pass filter over the wavelength range of 300-2000 nm.

A more readily realized design having fewer layers is illustrated in FIG. 4, which shows a transmittance spectrum for a 12 layer Si-Silica film again compared to the ideal NIR pass filter. The 12 layer film has a calculated average transmittance in the visible range between 380 and 780 nm of 0.171%, a calculated average transmittance in the NIR range between 850 and 1100 nm of 69.49%, and a calculated average transmittance in the range of 1100-2000 nm of 35.43%. As well be appreciated, actual lamps formed according to these designs may not achieve these properties due to difficulties in replicating the layer thicknesses precisely and suboptimal characteristics of the materials used.

Under normal operating conditions, the lamp may operate at a temperature of about 600° C.-700° C., or above, and can be as high as about 900° C. Lamps having a parabolic reflector have a tendency to concentrate the heat on the lamp vessel resulting in high operating temperatures under normal conditions. Under such operating conditions, it has been found that there is a tendency for the silicon layer(s) closest to the surface to be oxidized in normal atmospheres. Over time, this affects the thickness of the outer silicon layer(s). Because the thicknesses of the silicon and silica layers influence the transmission characteristics of the interference film, oxidation may result in a deterioration of the stop and pass band characteristics over the operating lifetime of the lamp. To reduce the effects of oxidation on transmission characteristics, the interference film may include an outer protective layer 50, exposed to atmosphere. In one embodiment, the outer protective layer is formed of silica. In this embodiment, the protective layer 50 has a sufficient thickness to prevent or at least slow down the diffusion of oxygen to the underlying silicon layer(s) 48, etc. The silica protective layer 50 may be at least twice as thick as the adjacent silicon layer 48 and in general, at least three times the thickness. In one embodiment, the protective layer 50 may be at least 1 micron in thickness, such as from 1-2 microns in thickness. The adjacent silicon layer 48 may be about 300 nm or less in thickness, e.g., about 200 nm or less and in one embodiment, from about 20 to 100 nm.

In another embodiment, the protective layer 50 may comprise a material which is more resistant to the penetration of oxygen than is silica, such as alumina. Diffusion of oxygen through alumina is about 5 orders of magnitude slower than it is through silica. In this embodiment, the other layers 44, 46, 48, etc. in the film may be silicon and silica with only the outermost layer 50 formed of alumina. The alumina layer 50 may be of a similar thickness to the other layers (e.g., about 200 nm) or may be thicker (e.g., 1-2 microns).

In another embodiment, some or all of the low refractive index material layers may comprise alumina rather than silicon. In this embodiment, the high refractive index layers may be silica. Thus, in this embodiment, the film 40 may comprise alternating layers of alumina and silica as the low and high refractive index materials.

The exemplary lamp assembly is particularly suited to use in active IR systems and avoids the need for additional components, such as a moveable IR-filter or a moveable IR transparent shield. Other components of the lamp assembly, such as the lens 30 and a lamp shroud, where present, may thus be substantially transmissive to visible light e.g., transmit at least 50% of the visible light which is incident thereon.

Without intending to limit the exemplary embodiment, the following examples illustrate the development of an exemplary interference film for a lamp.

EXAMPLE 1

Figure 5:
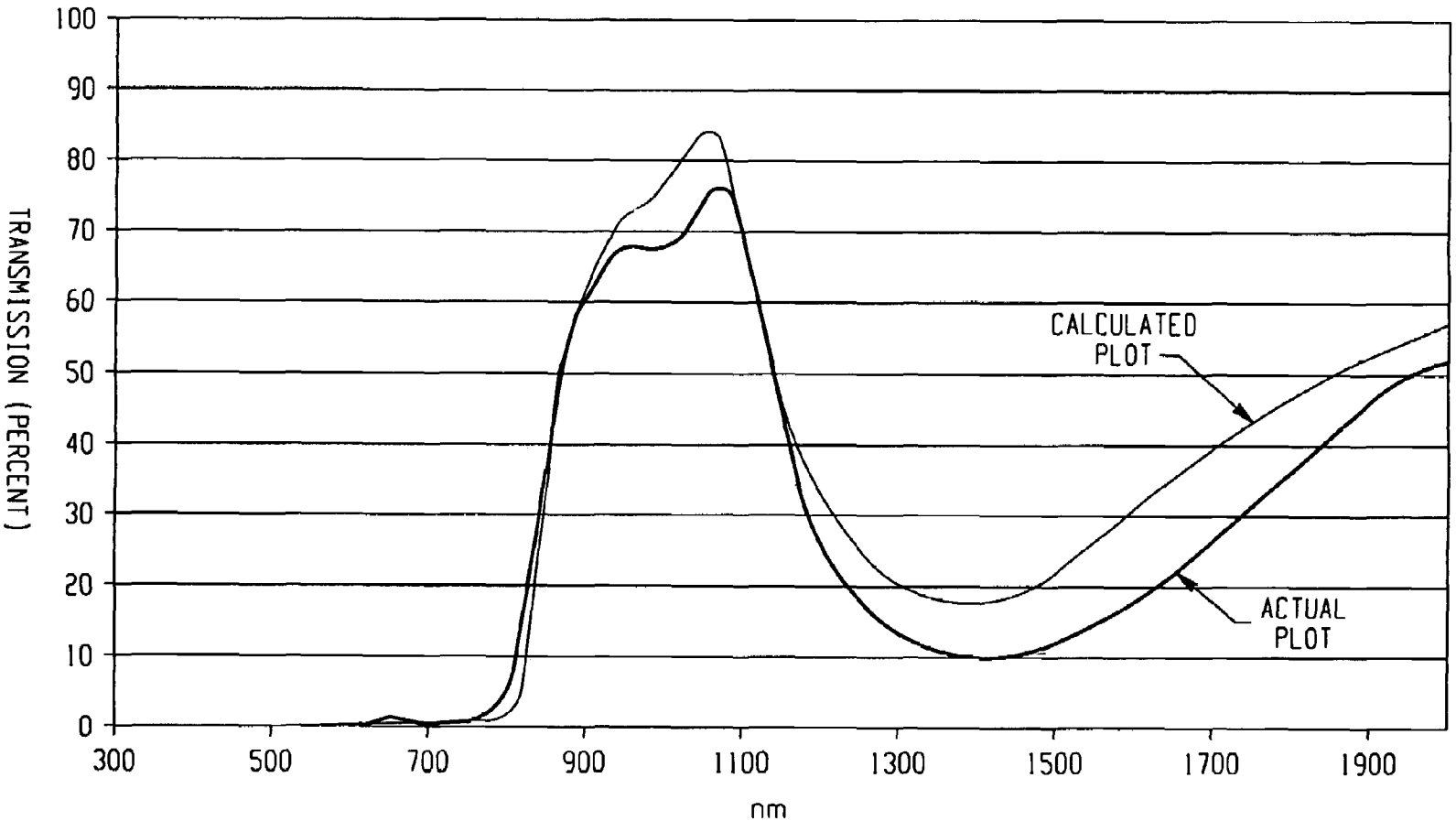
FIG. 5 illustrates a measured transmittance curve for a representative H7 lamp sample with a sputtered twelve-layer Si-Silica film compared to the calculated transmittance of the twelve layer design in the wavelength range of 300-2000 nm.
Figure 6:
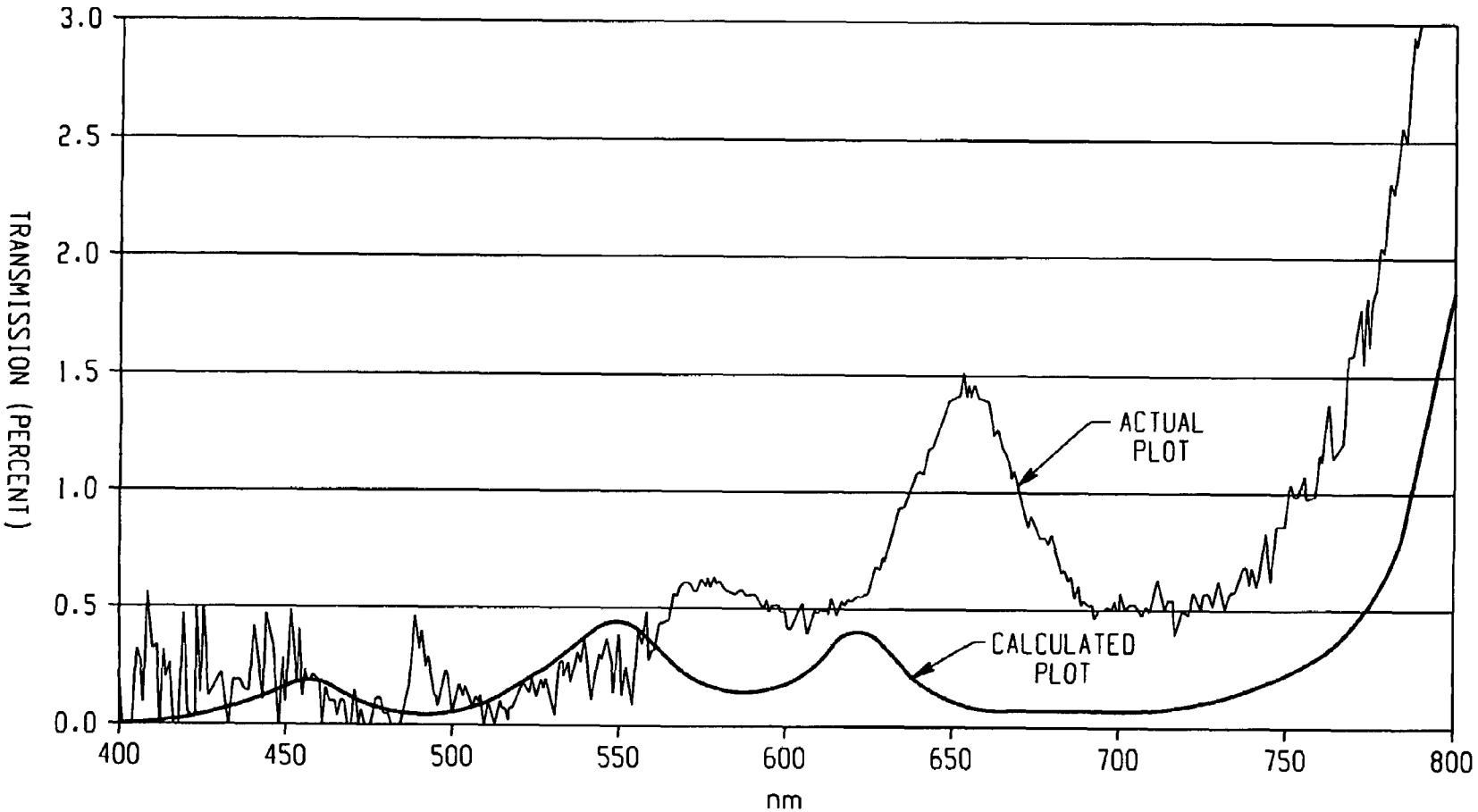
FIG. 6 illustrates a measured transmittance curve for the representative H7 lamp sample of FIG. 5 compared to the calculated transmittance of the twelve layer design in the wavelength range of 400 to 800 nm.

Multilayer films comprising alternating layers of silicon and silica were formed on H7 halogen bulbs by vacuum sputtering to provide a near infrared (NIR) band pass coating. FIGS. 4 and 5 illustrate a transmission curve for an actual 12 layer Si-Silica film and a comparison curve for the calculated transmittance of the 12 layer design showing close agreement. As can be seen the transmittance of the filter in the desired wavelength range of 850 nm to 1100 nm is high—with an average of at least 60% of the radiation over all wavelengths in this range being transmitted.

EXAMPLE 2

Figure 7:
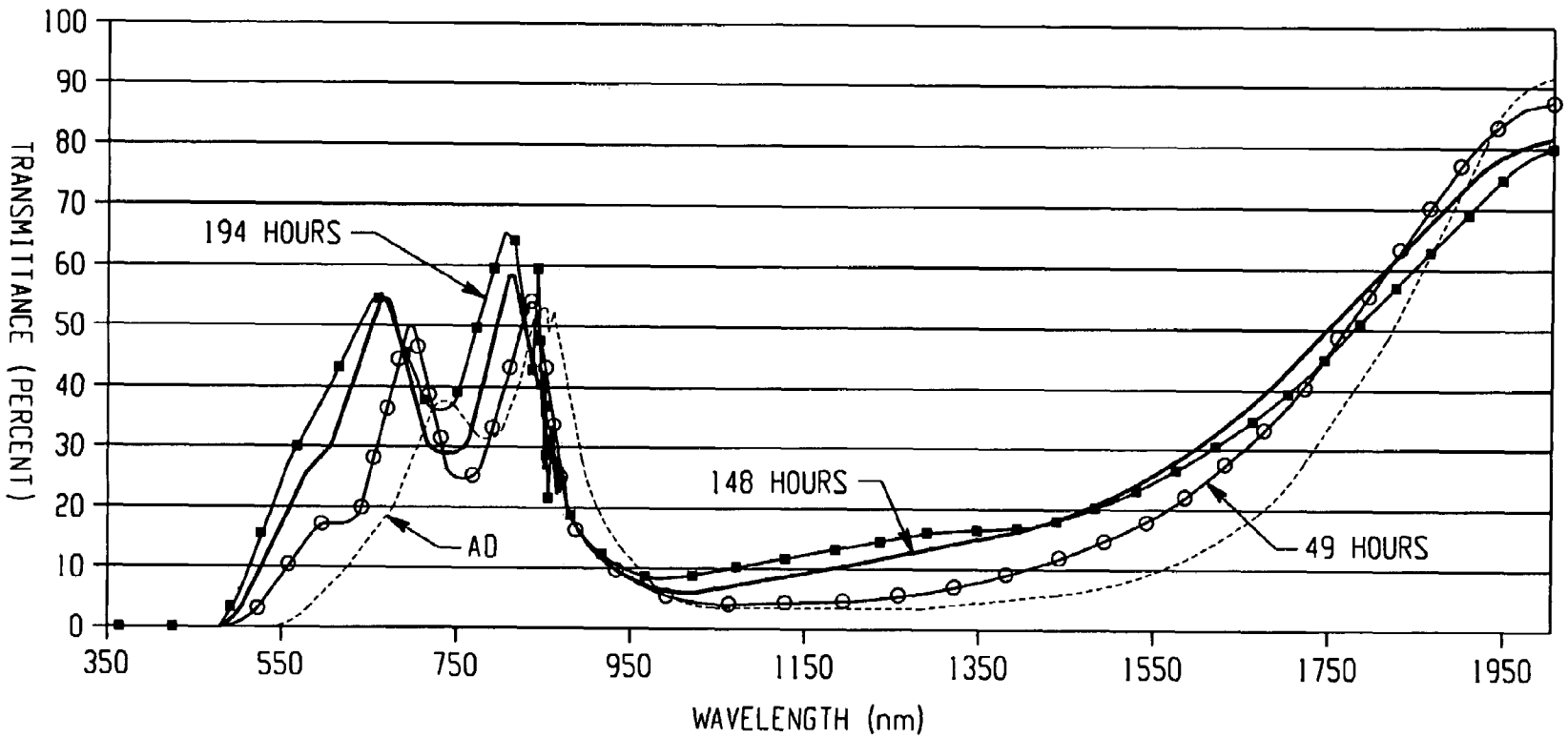
FIG. 7 illustrates measured transmittance curves at various times up to 194 hours for a six-layer Si-Silica sample at 700° C. in air.

Oxidation tests were performed on interference films to determine the susceptibility of the films to oxidation in air at temperatures in the range of 500-700° C. Tests were performed on a 6-layer Si-Silica stack formed by vacuum sputtering of quartz slides. The outermost layer of silica was on the order of 200 nm. Samples thus formed were placed in furnaces at temperatures of 500°, 600°, and 700°, in air. Transmittance curves were measured at various times up to 599 hours at 500° C., 491 hours at 600° C., and 194 hours at 700° C. At 500° C., no significant shift was observed in the visible part of the spectrum, and minimal shift occurred elsewhere over the length of the test. At 600° C., a significant shift in the spectrum was observed between 328 hr and 491 hr. This suggests that oxide growth and Si layer thickness reduction may become significant beyond the expected lamp life of 320 hr. As illustrated in FIG. 7, at 700° C., where spectra were recorded at 49, 148, and 194 hours, a significant shift in the spectrum was observed even at the first measurement at 49 hours (AD represents the spectrum of the as-deposited film, prior to temperature exposure). This suggests that oxide growth and Si layer reduction become significant at less than 50 hours at 700° C.

Table 1 shows calculated thicknesses in nanometers of the last (outermost) two layers of the film based on transmittance measurements for these conditions as determined with OptiRE software.

TABLE 1

| | Si Layer 5 | $SiO_2$ Layer 6 |
|---|---|---|
| Original | 83.41 | 241.11 |
| 49 Hour | 58.55 | 270.52 |
| 148 Hour | 35.71 | 299.30 |
| 194 Hour | 31.03 | 330.39 |
| Total loss (gain) | 52.38 | (89.28) |

It should be noted that errors may occur in calculating absolute thicknesses of the layers, but the trend is as expected with the Si layer 5 being oxidized and decreasing in thickness as the silica layer 6 increases in thickness. A layer thickness change greater than 10% may be considered significant, depending on the film design. According to the calculations, the thickness of layer 5 decreased by greater than 25% within the first 49 hours at 700° C.

For a 12-layer film similarly formed, measured transmittance curves for the as-deposited film and after 72 hours at 600° C. and 700° C., a slight, but nevertheless detectable alteration was observed after 72 hours at temperature. This suggests that films with a larger number of layers (or a thicker film design or thicker outermost layer) may be less sensitive to oxidation in terms of their optical performance.

Although the tests were performed in the absence of a protective layer, the results indicate that for optimal performance of the lamp assembly over the lifetime of the lamp, a protective layer may be beneficial, particularly at lamp operating temperatures in excess of 600° C.

The invention has been described with reference to the preferred embodiments. Obviously, modifications and alterations will occur to others upon reading and understanding the preceding detailed description. It is intended that the invention be construed as including all such modifications and alterations.

What is claimed is:

1. An electric lamp assembly for emitting near infrared radiation comprising:

a reflector housing;

a lamp vessel positioned within the reflector housing;

a source of illumination enclosed within the lamp vessel; and a continuous multi-layer interference film on an exterior surface of the lamp vessel which transmits near infrared radiation within the range of 850-1100 nm and is substantially non-transmissive towards visible radiation, the multilayer film including layers of at least two of silicon, silica, and alumina; and a protective outer layer which inhibits oxidation of an underlying adjacent layer of the multilayer film, the protective outer layer having a thickness which is at least twice a thickness of the adjacent layer of the multi-layer film.

2. The electric lamp assembly of claim 1, wherein the protective layer is formed of silica.

3. The electric lamp assembly of claim 2, wherein the protective layer has a thickness which is at least three times the thickness of the adjacent layer.

4. The electric lamp assembly of claim 1, wherein the protective layer is formed of alumina.

5. The electric lamp assembly of claim 1, wherein the film transmits an average of less than 1% of the radiation in the visible range from 380 to 750 nm.

6. The electric lamp assembly of claim 1, wherein the film transmits an average of less than 1% of the radiation in the visible range from 380 to 780 nm.

7. The electric lamp assembly of claim 1, wherein the film transmits an average of greater than 60% of the radiation in the range from 850 to 1100 nm.

8. The electric lamp assembly of claim 1, wherein the film transmits an average of less than 30% of the radiation in the range from 1200 to 1500 nm.

9. The electric lamp assembly of claim 1, wherein the film comprises at least six layers.

10. The electric lamp assembly of claim 1, wherein the film comprises at least twelve layers.

11. The electric lamp assembly of claim 1, wherein in operation, the multi-layer interference film is at a temperature of over 600° C.

12. The electric lamp assembly of claim 1, wherein the film is continuous over the entire surface of the vessel through which radiation is transmitted from the source.

13. The electric lamp assembly of claim 1, wherein the vessel encloses a fill containing a halogen which contacts an inner surface of the vessel.

14. An infrared night vision system comprising the electric lamp assembly of claim 1 and a camera which detects infrared radiation emitted by the lamp assembly which is reflected by an object.

15. An infrared night vision system comprising:

an electric lamp assembly for emitting near infrared radiation comprising:

a reflector housing, a lamp vessel positioned within the reflector housing, a source of illumination enclosed within the lamp vessel, a continuous multi-layer interference film on an exterior surface of the lamp vessel which transmits near infrared radiation within the range of 850-1100 nm and is substantially non-transmissive towards visible radiation; and a protective outermost layer formed of alumina which inhibits oxidation of an underlying layer of the multilayer film;

a camera which receives infrared radiation reflected from an object which is emitted by the electric lamp assembly; and a display which displays an image based on the reflected radiation received by the camera.

16. The infrared night-vision system of claim 15, wherein the protective layer has a thickness which is at least twice a thickness of an adjacent layer of the multi-layer film.

17. The infrared night-vision system of claim 15, wherein the multilayer film includes layers of at least two of silicon, silica, and alumina.

18. A method of operating an infrared night vision system comprising:

supplying power to a source of illumination which emits radiation in both the visible and infrared regions of the electromagnetic spectrum, whereby radiation emitted by the source is transmitted by a lamp vessel and filtered by a continuous multi-layer interference film on an exterior surface of the lamp vessel which is substantially non-transmissive towards the visible radiation and is substantially transmissive to radiation in the range of 850-1100 nm;

receiving infrared radiation reflected from an object which is emitted by the lamp vessel; and displaying an image based on the reflected radiation.

19. The method of claim 18, wherein in operation, the film is at a temperature of at least 600° C.

* * * * *